US010627140B2

(12) United States Patent
Kaspar et al.

(10) Patent No.: US 10,627,140 B2
(45) Date of Patent: Apr. 21, 2020

(54) RECEIVER

(71) Applicant: MAHLE International GmbH, Stuttgart (DE)

(72) Inventors: Martin Kaspar, Fellbach (DE); Herbert Hofmann, Stuttgart (DE); Uwe Foerster, Erdmannhausen (DE)

(73) Assignee: MAHLE International GmbH, Stuttgart (DE)

( * ) Notice: Subject to any disclaimer, the term of this patent is extended or adjusted under 35 U.S.C. 154(b) by 299 days.

(21) Appl. No.: 14/862,603

(22) Filed: Sep. 23, 2015

(65) Prior Publication Data

US 2016/0010906 A1 Jan. 14, 2016

Related U.S. Application Data

(63) Continuation of application No. PCT/EP2014/057328, filed on Apr. 10, 2014.

(30) Foreign Application Priority Data

Apr. 11, 2013 (DE) ..... 10 2013 206 357

(51) Int. Cl.
*F25B 43/00* (2006.01)

(52) U.S. Cl.
CPC ..... *F25B 43/006* (2013.01); *F25B 43/003* (2013.01); *F25B 2339/0441* (2013.01); *F25B 2339/0444* (2013.01); *F25B 2400/16* (2013.01); *F25B 2400/23* (2013.01)

(58) Field of Classification Search
CPC ..... F25B 2339/044; F25B 2400/16; F25B 2339/0441; F25B 43/006; F25B 43/003
USPC ..... 138/109, 30
See application file for complete search history.

(56) References Cited

U.S. PATENT DOCUMENTS

| | | | |
|---|---|---|---|
| 3,420,071 | A | 1/1969 | Bottum |
| 3,572,050 | A | 3/1971 | Bottum |
| 3,837,177 | A | 9/1974 | Rockwell et al. |
| 4,954,252 | A | 9/1990 | Griffin et al. |
| 5,365,751 | A | 11/1994 | Mikesell et al. |

(Continued)

FOREIGN PATENT DOCUMENTS

| | | |
|---|---|---|
| DE | 1 501 059 B | 9/1969 |
| DE | 1 551 319 A1 | 3/1970 |

(Continued)

OTHER PUBLICATIONS

English Translation of JP-2001099525-A (Year: 2001).*
Chinese Office Action for Chinese Application No. 201480017831.8 dated Aug. 19, 2016 with English translation.

*Primary Examiner* — David J Teitelbaum
(74) *Attorney, Agent, or Firm* — Muncy, Geissler, Olds & Lowe, P.C.

(57) ABSTRACT

A receiver having a receiver housing that has a fluid-receiving chamber, a fluid inlet, and a fluid outlet. A drier is provided in the fluid-receiving chamber. The receiver is has an inlet channel protrudes into the fluid-receiving chamber, which inlet channel has a channel outlet in the fluid-receiving chamber and conducts fluid into the fluid-receiving chamber from the fluid inlet as a channel inlet, the inlet channel being shaped in such a way that the fluid flowing out of the channel outlet flows out in a lateral direction. A condenser having the receiver is also provided.

17 Claims, 4 Drawing Sheets

(56) References Cited

U.S. PATENT DOCUMENTS

| | | | | |
|---|---|---|---|---|
| 5,596,882 | A | 1/1997 | Hutchison et al. | |
| 5,937,671 | A | 8/1999 | Inoue et al. | |
| 6,341,647 | B1 | 1/2002 | Nobuta et al. | |
| 7,287,399 | B2 * | 10/2007 | Obrist | F25B 9/008 62/503 |
| 7,712,330 | B2 * | 5/2010 | Hosokawa | F25B 39/04 62/474 |
| 2003/0070551 | A1 | 4/2003 | Fisk et al. | |
| 2003/0121278 | A1 | 7/2003 | Ichimura et al. | |
| 2005/0115270 | A1 * | 6/2005 | Furuta | B60H 1/00978 62/475 |
| 2010/0199713 | A1 * | 8/2010 | Guitari | F25B 43/006 62/503 |

FOREIGN PATENT DOCUMENTS

| | | | | |
|---|---|---|---|---|
| DE | 197 48 662 | A1 | 5/1998 | |
| EP | 0 769 666 | A1 | 4/1997 | |
| JP | H 05-196326 | A | 8/1993 | |
| JP | H 07-190567 | A | 7/1995 | |
| JP | H 11-6669 | A | 1/1999 | |
| JP | 2000-227265 | A | 8/2000 | |
| JP | 2000 337738 | A | 12/2000 | |
| JP | 2001099525 | A * | 4/2001 | F25B 39/04 |
| JP | 2004-190956 | A | 7/2004 | |

* cited by examiner

RECEIVER

This nonprovisional application is a continuation of International Application No. PCT/EP2014/057328, filed Apr. 10, 2014, which claims priority to German Patent Application No. 10 2013 206 357.1, filed Apr. 11, 2013, both of which are herein incorporated by reference.

BACKGROUND OF THE INVENTION

Field of the Invention

The invention relates to a receiver for a refrigerant for a refrigerant circuit, in particular of a motor vehicle, according to the preamble of claim 1, as well as to a condenser with such a receiver.

Description of the Background Art

Receivers for a refrigerant of a refrigerant circuit are known in the art. These receivers stockpile the refrigerant to have sufficient refrigerant available in the refrigerant circuit even with operational fluctuations of the filling volume.

Further, a drying agent is often provided in the receiver in order to dry the refrigerant and to filter out moisture from the refrigerant.

In the refrigerant circuit, the receiver is often arranged after the condenser or in the fluid stream between a condensation zone and a sub-cooling zone of the condenser. The refrigerant hereby flows from the condenser or from the condensation zone of the condenser into the receiver where the refrigerant is separated into a gaseous phase and a liquid phase. The gaseous phase collects above the liquid phase in the receiver and the liquid phase can be discharged out of the receiver from below the gaseous phase.

If gaseous refrigerant is also channeled from the receiver into the subsequent sub-cooling zone, this gaseous refrigerant must first condense in the sub-cooling zone so that the further lowering of the refrigerant temperature for the gaseous portion cannot take place until the gaseous portion is condensed. This reduces the effectiveness of the sub-cooling zone since a part of its effectiveness does not cause the lowering of the temperature of the refrigerant, but only its condensation.

This ultimately results in that the maximum sub-cool temperature is not reached, and the effectiveness of the subsequent evaporator is thus not optimal.

The filling level of the receiver with refrigerant depends on the load condition of the refrigerant circuit but also on the filling volume and any possible leakages. In the process, refrigerant is channeled into the subsequent sub-cooling zone under any operating condition, i.e. at any filling level of the refrigerant in the receiver.

SUMMARY OF THE INVENTION

It is therefore an object of the invention to provide a receiver in which the gaseous portion in the liquid refrigerant flowing from the receiver is minimized over wide operating ranges or at different filling levels. The object is also to provide a condenser with such a receiver.

An embodiment of the invention provides a receiver with a receiver housing having a fluid-receiving chamber, with a fluid inlet and a fluid outlet, wherein in the fluid-receiving chamber a drier is provided. An inlet channel featuring a channel outlet in the fluid-receiving chamber protrudes into the fluid-receiving chamber. The channel outlet allows fluid from the fluid inlet as inlet channel to pass into the fluid-receiving chamber, wherein the inlet channel is shaped in such a way that the fluid flowing out of the channel outlet flows in a lateral direction at a distance from the central axis of the receiver. This ensures that the fluid flows into the receiver on a circular or spiral path and that consequently a good separation of gaseous and liquid refrigerant in the fluid-receiving chamber of the receiver is achieved. As a result, the gaseous portion is reduced or avoided during the outflow of fluid from the receiver.

According to an embodiment of the invention, it is expedient when above the channel outlet there can be an unobstructed volume of at least 50% of the gross volume of the receiver in this section, and which extends over a height of, for example, at least 50% of the total internal height of the receiver.

It is hereby advantageous if a drier such as drying granulate is positioned below the channel outlet, on a side facing away from the unobstructed volume.

It is also useful when a drier such as drying granulate is positioned at an upper end of the receiver.

It is also advantageous if the receiver volume features an essentially constant cross-sectional area.

A cross section of the receiver can have a round shape.

Furthermore, in an embodiment of the invention, the receiver housing can have a round cross section with a cylindrical wall. This ensures that the fluid flowing from the channel outlet is forced in a circular flow towards the cylindrical wall of the receiver housing, allowing the gas portion to better rise and separate from the liquid portion.

The inlet channel can have at its channel outlet, an outlet port that is twisted by about 90° to a longitudinal axis of the channel. This allows the outflowing fluid stream to emerge approximately at a right angle to the longitudinal axis of the channel. This allows the fluid to essentially flow in a horizontal plane and to be forced onto a spiral path in order to lengthen the path of the fluid so that the phase separation is improved.

The channel outlet can be shaped as a pipe bend. This allows for a simple deflection of the fluid.

The channel outlet can be designed as an obliquely cut pipe end in which the long protruding pipe wall side is folded towards the short pipe wall side. Because the long protruding pipe wall side is bent towards the short pipe side wall by about 90°, an advantageous structure is achieved which corresponds to a simple deflection of about 90°. This structure is achieved by the oblique cutting of the pipe and the subsequent folding of a pipe wall side.

The drier can be arranged between two fluid-permeable retaining discs, wherein the inlet channel passes through at least one of the retaining discs, advantageously through both retaining discs. This way, the drier can be arranged between the two retaining discs, wherein the inlet channel penetrates the retaining discs. This ensures that the fluid does not directly traverse the drier on its way to the fluid-receiving chamber, but instead is separately channeled from the inlet channel through the drier. On the way back from the fluid-receiving chamber to the fluid outlet, however, the fluid must flow through the drier, i.e. through the retaining discs and the drying granulate arranged in between. Thus, the drier is only perfused once from entrance to exit of the fluid-receiving chamber.

The drier can be arranged between a base wall or a top wall and a fluid-permeable retaining disc. The drier may be located at the top or base area of the fluid-receiving chamber so that it is arranged in a space-saving and cost-effective manner with only one retaining disc.

The one retaining disc can be penetrated by the inlet channel. This is particularly the case when the drier is arranged at the lower portion of the receiver.

The inlet channel can be connected to a fluid deflector which deflects the flow of fluid from the fluid-receiving chamber to the fluid outlet. The direct route to the fluid outlet is thereby obstructed, resulting in a deflection of the fluid to extend the path for the fluid and promoting phase separation.

The fluid deflector can be a wall which is aligned essentially perpendicular to the longitudinal direction of the inlet channel.

Thus, a simple and inexpensive type of obstruction and deflection are obtained. The wall can be formed as a flat disc with an opening for the inlet channel to pass through.

A gap can be provided between the wall as fluid deflector and the wall of the receiver housing for the passing through of the fluid to the fluid outlet. Thus, a selectively dimensioned passage can be created without the need for separate components.

A filter can be arranged between the fluid deflector and the fluid outlet. This allows the fluid deflector to also serve as a filter support so that there is no need for a separate retainer. The retainer can be integrated into the fluid deflector.

The filter can cover the fluid outlet with one of its side surfaces and is covered by the fluid deflector on one of the opposite side surfaces. Thus, a defined arrangement and perfusion of the filter is attained. The mounting takes place between the edge area of the fluid outlet and the fluid deflector whereas the inflow towards the filter occurs laterally from the side.

The retaining disc can be a perforated plastic or sheet-metal disc. This enables the disc to be economically produced by injection molding or stamping.

The channel outlet can be designed as a pipe socket with an adapter piece, particularly of plastic, that is attached or inserted.

The fluid inlet and/or the fluid outlet can be arranged on a base plate of the receiver.

An embodiment relates to a condenser for a refrigeration circuit, in particular of a motor vehicle, with a block having first and second fluid channels, wherein a refrigerant flows through the first fluid channels and a coolant flows through the second fluid channels, and wherein the first fluid channels are divided into a condensation zone for condensing the refrigerant and into a sub-cooling zone for the sub-cooling of the liquid refrigerant, wherein the receiver is arranged in the fluid stream between the condensation zone and the sub-cooling zone or after the sub-cooling zone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
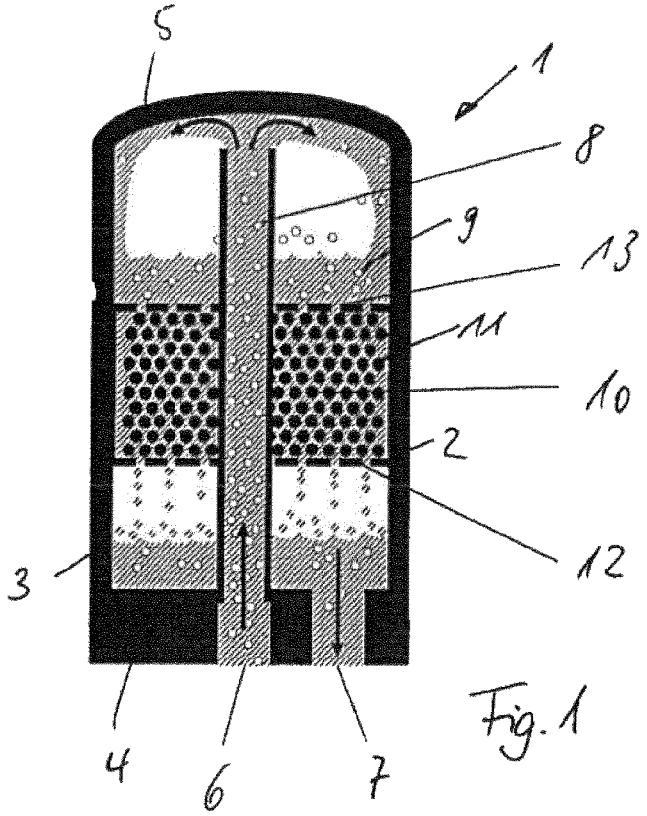
FIG. 1 is a receiver according to the conventional art.

FIG. 1 shows a receiver 1 for a refrigerant of a refrigerant circuit of a motor vehicle according to the conventional art. The receiver 1 comprises a receiver housing 2 having a cylindrical wall 3 and a base 4 and a cover 5.

In the base 4, a fluid inlet 6 and a fluid outlet 7 are provided. The fluid inlet 6 represents a hole through the base 4, as does the fluid outlet 7. A riser pipe 8 is arranged at the inside of the fluid inlet 6 which communicates with the fluid inlet 6 and essentially extends through the entire receiver in a vertical direction. If a refrigerant 9 flows through the fluid inlet 6, it passes through the riser pipe 8 vertically upwards and flows into the fluid-receiving chamber at the upper end of the riser pipe 8. There, the refrigerant essentially drops and reaches the fluid outlet 7 after flowing through the drier 10. The drier 10 is positioned approximately in the center of the receiver housing 2, wherein a portion of the drying granulate 11 is held between two perforated discs. The drying granulate is thus held on both sides of a perforated disc 12, 13, spaced at a distance from one another. The refrigerant 9 which flows out at the upper end of the riser tube 8, passes through the drier by flowing through the upper perforated disc and flowing past the drying granulate. It then flows through the lower perforated disc.

Figure 2:
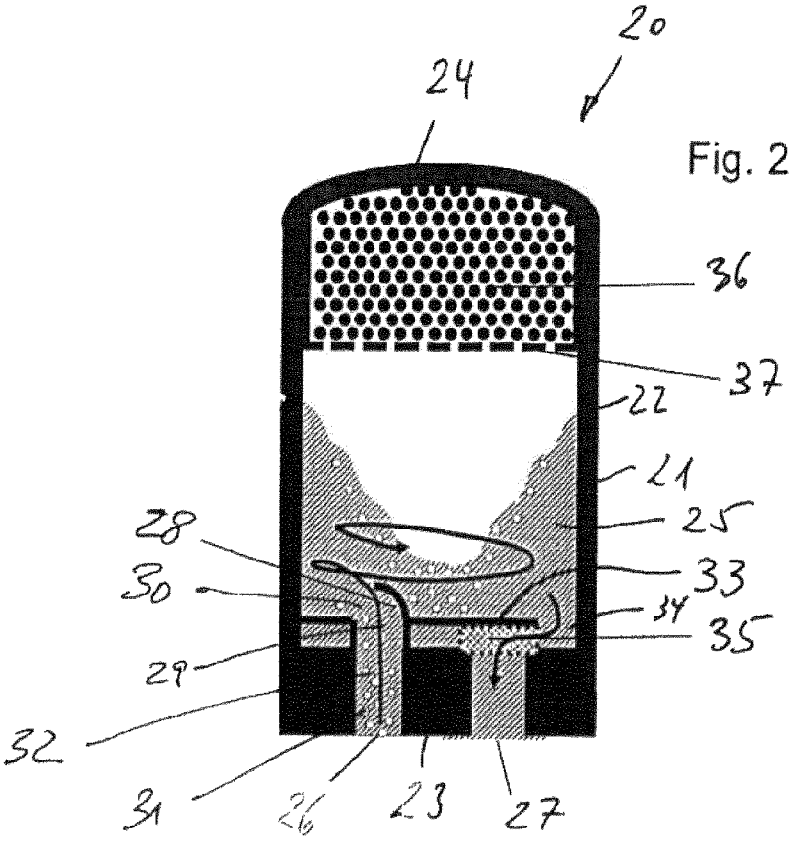
FIG. 2 illustrates a receiver according to an exemplary embodiment of the invention.

FIG. 2 shows a schematic representation of an inventive receiver 20 with a receiver housing 21. The receiver housing 21 is composed of a cylindrical wall 22 as well as a base 23 and a cover 24. The receiver housing 21 may preferably be formed from a pipe which forms the wall 22, wherein the base 23 can be integrated with the pipe and the cover can be connected with the pipe or designed as one piece. The receiver 20 forms a fluid-receiving chamber 25 inside the receiver housing 21, wherein the receiver 20 features a fluid inlet 28 and a fluid outlet 27. The fluid inlet 26 and fluid outlet 27 are designed as holes in the base 23.

The fluid inlet 26 and fluid outlet 27 form openings or holes in the base 23 and serve for fluid communication between an external connection and the fluid-receiving chamber 25. In the interior of the fluid-receiving chamber 25, an inlet port 28 is provided which is fluidly connected to the fluid inlet 26 and which protrudes into the fluid-receiving chamber 25. The fluid inflowing through the fluid inlet 26, such as refrigerant 29, passes through the inlet channel 28 and exits from the channel outlet 30 of the inlet channel 28. The channel inlet 31 may coincide with the fluid inlet 26 or it may join the fluid inlet roughly where the inlet channel 28 starts at the base 23. Advantageously, the inlet channel 28 is a pipe which is inserted into the base 23 or is attached to the base 23. For this purpose, the pipe which forms the inlet channel 28 can be inserted in an opening of the base 23 or can be attached to or at an intake.

The inlet channel 28 is shaped such at its channel outlet 30 that, in interaction with the wall 22 of the receiver housing 21, it causes the fluid flowing out of the channel outlet 30 to assume a spiral-shaped flow inside the fluid-receiving chamber. For this purpose, the inlet channel 28 features at its channel outlet 30 an outlet port which is twisted about 90° to a longitudinal axis 32. This causes the outflowing fluid stream to leave the channel outlet 30 at about a right angle to the longitudinal axis of the channel 32. Spiral-shaped can be, for example, an arched or circular flow, or a flow moving roughly along a circular path, which can also be designed with a velocity component in the vertical position so that the fluid can move upwards or downwards from an inflow plane.

In further embodiments, the angle of 90° to the longitudinal axis of the channel can in this respect take on deviating values, for example between 45° and 135°, so that the flow of the fluid is channeled from the channel outlet 30 towards the cylindrical wall 22, while at the same time, the fluid stream also features a velocity component vertically upwards or downwards.

The effluent from the fluid outlet 27 encounters the cylindrical wall 22 with a velocity component and is deflected there to a circular arc or onto a spiral path.

With the inlet channel 28, a fluid deflector 33 is connected such that the fluid deflector 33 is designed as a specifically horizontal, for example, wall. The inlet channel 28 hereby penetrates the fluid deflector 33 so that a fluid flowing out of the channel outlet 30 cannot directly flow to the fluid outlet 27, but instead is deflected by this fluid deflector 33. The fluid deflector 33 is, for example, designed as a flat plate which is either formed together with the inlet channel 28 or connected to and supported by the inlet channel 28, wherein the inlet channel 28 can pass as a pipe through an opening of the fluid deflector 33. A gap 34 may remain between the edge of the fluid deflector 33 and the wall 22 through which the fluid 29 passes before it reaches the fluid outlet 27.

Between the fluid deflector 33 and the fluid outlet 27, a filter 35 which rests on the fluid outlet and is covered by the fluid deflector 33 can optionally be arranged. This causes a lateral inflow of the fluid 29 into the filter 35 so that the fluid in the filter 35 is essentially deflected by 90° before it arrives at the fluid outlet 27.

In the embodiment of FIG. 2, the drier 36 is located at the upper end in the cover 24 area, wherein the drier 36 is incorporated as granulate between a top wall 24 and a retaining disc 37. The retaining disc 37 is a fluid-permeable disc, such as a perforated disc, or a grid or the like. The retaining disc 37 is preferably secured to or retained at the inner wall of the receiver case 21, so that the drier 36 of the drying granulate remains between the cover 24 and the retaining disc 37. For example, the retaining disc 37 may also be spring-loaded so that it presses on the drying granulate in axial direction on the cover, and thus compresses.

Figure 3:
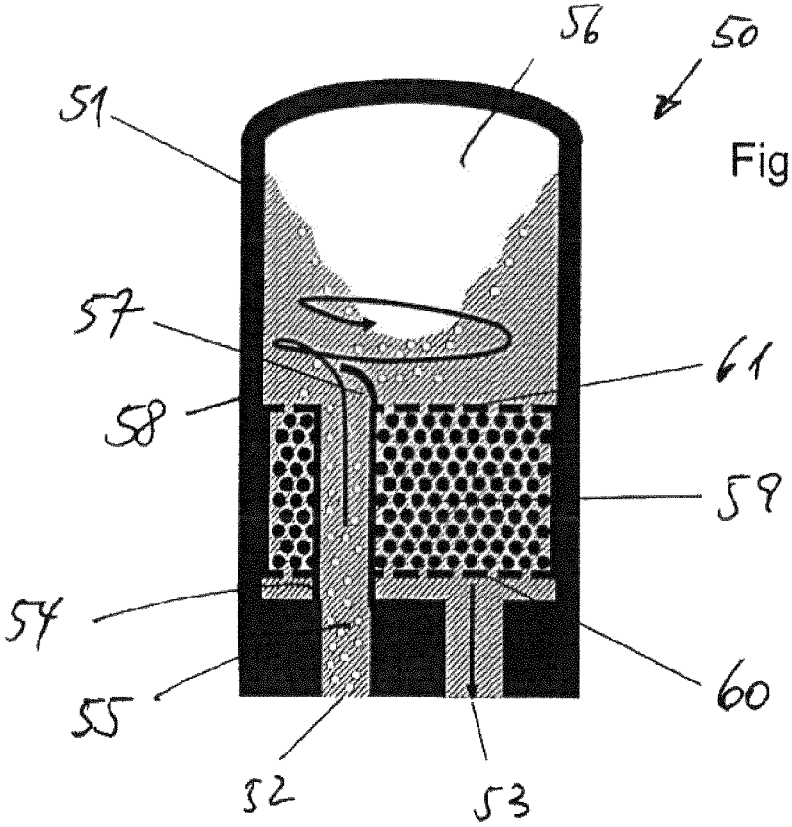
FIG. 3 illustrates an exemplary embodiment of a receiver according to the invention.

FIG. 3 shows another embodiment of a receiver 50 according to the invention, in which inside the receiver case 51 with a fluid inlet 52 and a fluid outlet 53 is a tubular inlet channel 54 through which the fluid 55 can flow into the fluid-receiving chamber 56. The channel outlet 57 is in turn designed such that a lateral, essentially horizontal outflow of fluid 55 takes place in the direction of the wall 58 so that the fluid is forced in a spiral or circular path.

The drier 59 is arranged between two retaining discs 60, 61 which are penetrated by the tubular inlet channel 54. The fluid flows above the upper retaining disc 51 from the inlet channel 54 into the fluid-receiving chamber 56 and enters the drier through the upper retaining disc 61, a fluid-permeable retaining disc. There, it flows around the arranged drying granulate and then flows through the lower retaining disc 60 towards the fluid outlet 53.

Figure 4:
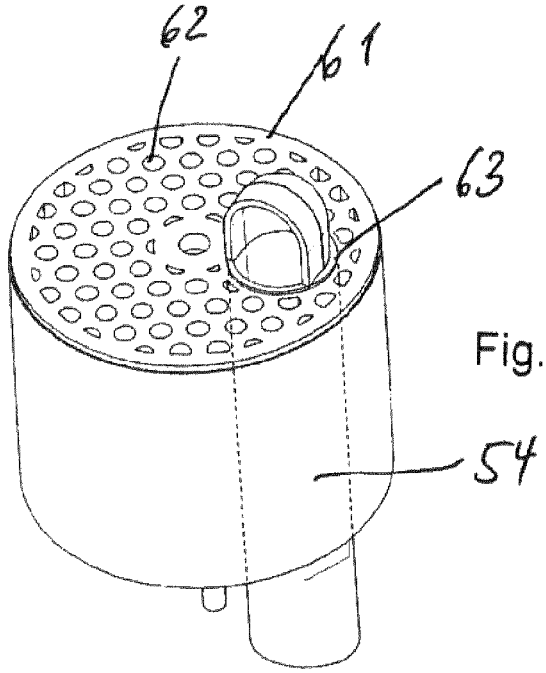
FIG. 4 illustrates a detail of an exemplary embodiment of a receiver according to the invention.

FIG. 4 shows the arrangement of the upper retaining disc 61 relative to the tubular inlet channel 54. In this case, the retaining disc 61 features a plurality of openings 62 through which the fluid can flow. Further, the retaining disc 61 has a larger opening 63 through which the inlet channel 54 can pass through as a tubular element. The upper end of the fluid inlet channel with its end portion formed as a pipe bend or as a cap with a side opening, projects beyond the retaining disc 61. This way, the fluid can flow out from the inlet channel 54 in a lateral direction above the retaining disc 61.

Figure 5:
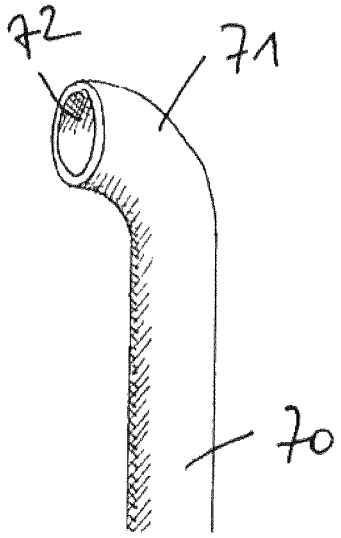
FIG. 5 illustrates an exemplary embodiment for an inlet channel.

FIG. 5 shows an inlet channel 70 which is formed as a pipe. At the upper end, the inlet channel 70 features a pipe bend 71 ending in a channel outlet 72 which is located in a plane that is perpendicular to the cross section of the fluid inlet of the receiver, and to the cross section of the vertical portion of the tubular inlet channel 70.

Figure 6:
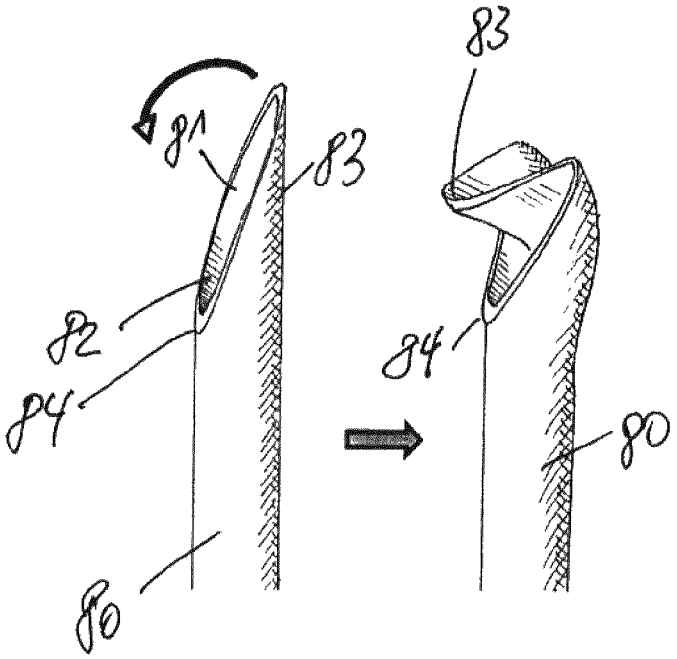
FIG. 6 illustrates an exemplary embodiment for a further inlet channel.

FIG. 6 shows in the figure on the left an inlet channel 80 which is cut obliquely at its upper end 81. In this case, the inlet channel features a channel outlet 82 which is formed by the obliquely cut end of the pipe, the pipe having a long protruding pipe wall side 83 and a short pipe wall side. Following the cross-cutting of the inlet channel, the long protruding pipe wall side is bent in the direction of the short tubular wall face 84 so that a channel outlet is formed which in essence allows a lateral outflow of the fluid from the inlet channel, see FIG. 6, illustration on the right.

Figure 7:
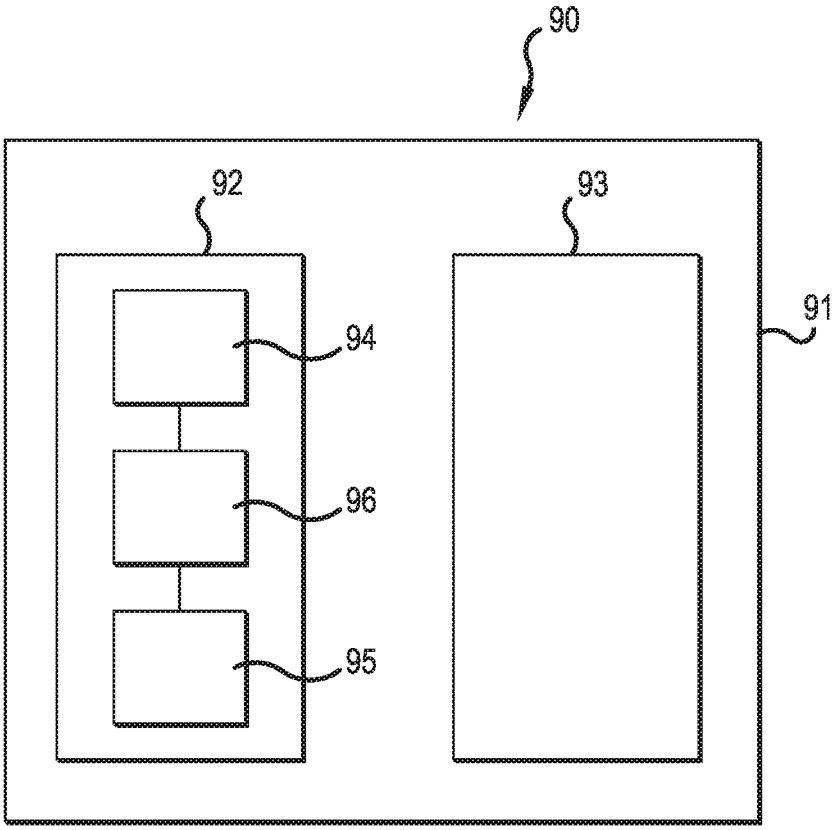
FIG. 7 illustrates a basic black box diagram of a condenser having a receiver therein.

FIG. 7 shows a basic black box diagram of a condenser 90 for a refrigeration circuit, with a block 91 having first and second fluid channels. A refrigerant flows through the first fluid channel 92 and a coolant flows through the second fluid channel 93. The first fluid channel 92 is divided into a condensation zone 94 for condensing the refrigerant and into a sub-cooling zone 95 for the sub-cooling of the liquid refrigerant. The receiver 96 is arranged in the fluid stream between the condensation zone 94 and the sub-cooling zone 95 or after the sub-cooling zone 95.

Individual characteristics of different embodiments are generally combined with one another without loss of generality and without special mention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A receiver comprising:

a receiver housing with a fluid-receiving chamber having a fluid inlet and a fluid outlet;

a drying granulate arranged in the fluid-receiving chamber; and an inlet channel extending into the fluid-receiving chamber from the fluid inlet, the inlet channel having a channel outlet in the fluid-receiving chamber that feeds fluid from the fluid inlet into the fluid-receiving chamber, the channel outlet of the inlet channel being curved in a direction away from a central axis of the receiver, such that the fluid flowing out of the channel outlet flows in a lateral direction at a distance from the central axis of the receiver and initially flows in the lateral direction away from the central axis of the receiver, wherein the fluid inlet and the fluid outlet each include an opening provided in a base wall of the receiver housing, wherein the receiver housing includes a top wall that opposes the base wall and side walls that connect between the top wall and the base wall, and wherein the drying granulate is arranged at an upper end of the receiver, such that a portion of the drying granulate directly contacts an inner surface of the top wall of the receiver housing, and wherein an outer surface of the top wall forms an exterior surface of the receiver housing.

2. The receiver according to claim 1, wherein above the channel outlet there is an unobstructed volume which comprises at least 50% of a gross volume of the receiver in this section and which extends over a height of at least 50% of the total internal height of the receiver.

3. The receiver according to claim 1, wherein a receiver volume has a constant cross-sectional area.

4. The receiver according to claim 1, wherein a cross section of the receiver has a round shape.

5. The receiver according to claim 1, wherein the channel outlet is a pipe bend.

6. The receiver according to claim 1, wherein the channel outlet is an obliquely cut pipe end in which a long protruding pipe wall side is folded towards a short pipe wall side.

7. The receiver according to claim 6, wherein the obliquely cut pipe end is provided at a distal end of the channel outlet.

8. The receiver according to claim 1, wherein the channel outlet is a pipe socket with an attached or inserted adapter piece made of plastic.

9. The receiver according to claim 1, wherein the drying granulate is arranged between the top wall and a fluid-permeable retaining disc.

10. The receiver according to claim 9, wherein the retaining disc is a perforated plastic or sheet-metal disc.

11. The receiver according to claim 1, wherein a fluid deflector that deflects a flow of fluid from the fluid-receiving chamber to the fluid outlet is coupled with the inlet channel.

12. The receiver according to claim 11, wherein the fluid deflector is a solid, non-perforated wall that is oriented perpendicular to the longitudinal direction of the inlet channel.

13. The receiver according to claim 12, wherein a gap for flow-through of the fluid from the fluid-receiving chamber to the fluid outlet is provided between an outer peripheral edge of the fluid deflector and an inner side wall of the receiver housing, such that the fluid flows from the fluid-receiving chamber into the gap, then from the gap into a filter and then from the filter into the fluid outlet.

14. The receiver according to claim 11, wherein a filter is arranged between the fluid deflector and the fluid outlet.

15. The receiver according to claim 11, wherein the fluid deflector is a solid, non-perforated wall.

16. A receiver comprising:

a receiver housing with a fluid-receiving chamber having a fluid inlet and a fluid outlet;

a drying granulate arranged in the fluid-receiving chamber; and an inlet channel extending into the fluid-receiving chamber from the fluid inlet, the inlet channel having a channel outlet in the fluid-receiving chamber that feeds fluid from the fluid inlet into the fluid-receiving chamber, the channel outlet of the inlet channel being curved in a direction away from a central axis of the receiver, such that the fluid flowing out of the channel outlet flows in a lateral direction at a distance from the central axis of the receiver and initially flows in the lateral direction away from the central axis of the receiver, wherein the fluid inlet and the fluid outlet each include an opening provided in a base wall of the receiver housing, wherein the receiver housing includes a top wall that opposes the base wall and side walls that connect between the top wall and the base wall, and wherein the drying granulate is arranged at an upper end of the receiver, such that a portion of the drying granulate directly contacts an inner surface of the top wall of the receiver housing, wherein a fluid deflector that deflects a flow of fluid from the fluid-receiving chamber to the fluid outlet is coupled with the inlet channel, wherein a filter is arranged between the fluid deflector and the fluid outlet, and wherein the filter covers the fluid outlet with a first filter side surface and is covered by the fluid deflector on a second filter side surface that opposes the first filter side surface.

17. A condenser for a refrigerant circuit of a motor vehicle, comprising:

a block having a first fluid channel and a second fluid channel, a refrigerant adapted to flow through the first fluid channel and a coolant adapted to flow through the second fluid channel, the first fluid channel being divided into a condensation zone for condensing the refrigerant and into a sub-cooling zone for sub-cooling the liquid refrigerant; and a receiver arranged in a fluid stream between the condensation zone and the sub-cooling zone or after the sub-cooling zone, wherein the receiver comprises:

a receiver housing with a fluid-receiving chamber having a fluid inlet and a fluid outlet;

a drying granulate arranged in the fluid-receiving chamber; and an inlet channel extending into the fluid-receiving chamber from the fluid inlet, the inlet channel having a channel outlet in the fluid-receiving chamber that feeds fluid from the fluid inlet into the fluid-receiving chamber, the channel outlet of the inlet channel being curved in a direction away from a central axis of the receiver, such that the fluid flowing out of the channel outlet flows in a lateral direction at a distance from the central axis of the receiver and initially flows in the lateral direction away from the central axis of the receiver, wherein the fluid inlet and the fluid outlet each include an opening provided in a base wall of the receiver housing, wherein the receiver housing includes a top wall that opposes the base wall and side walls that connect between the top wall and the base wall, and wherein the drying granulate is arranged at an upper end of the receiver, such that a portion of the drying granulate directly contacts an inner surface of the top wall of the receiver housing, and wherein an outer surface of the top wall forms an exterior surface of the receiver housing.

* * * * *